US005836523A

United States Patent [19]

Johnson

[11] Patent Number: 5,836,523

[45] Date of Patent: Nov. 17, 1998

[54] APPARATUS AND METHOD FOR REDUCING MATERIAL

[76] Inventor: Norman W. Johnson, P.O. Box 726, Gilbert, Ariz. 85299

[21] Appl. No.: 814,776

[22] Filed: Mar. 10, 1997

[51] Int. Cl.[6] ..... B02C 19/00

[52] U.S. Cl. ..... 241/5; 241/29; 241/152.2; 241/252; 241/253; 241/259.1; 241/275

[58] Field of Search ..... 241/275, 29, 252, 241/253, 251, 259, 259.1, 5, 30, 152.2

[56] References Cited

U.S. PATENT DOCUMENTS

| | | | |
|---|---|---|---|
| 1,030,194 | 6/1912 | Lieber | 241/253 |
| 1,075,192 | 10/1913 | Capen . | |
| 1,670,714 | 5/1928 | Craig | 241/253 |
| 2,589,307 | 3/1952 | Symons | 241/252 |
| 2,718,821 | 9/1955 | Cumpston, Jr. . | |
| 3,229,923 | 1/1966 | Conley et al. | 241/253 |
| 3,926,380 | 12/1975 | Musgrove et al. . | |
| 4,257,564 | 3/1981 | Pamplin . | |
| 4,964,580 | 10/1990 | Akesaka | 241/252 |

*Primary Examiner*—Mark Rosenbaum
*Attorney, Agent, or Firm*—H. Gordon Shields

[57] ABSTRACT

Reducing apparatus includes a bottom rotor rotatable at a relatively high speed to provide relatively high centrifugal and G forces for reducing material disposed on the rotor. An upper conical element is disposed above the rotor and is free-wheeling relative to the bottom rotor, and thus rotates in response to rotation of the bottom rotor. Material to be reduced moves downwardly onto the bottom rotor through the conical element. High centrifugal and G forces resulting from the high rotational speed of the bottom rotor move the material outwardly to impinge upon the conical element for reduction. Vertical spacing between the two rotating members may be adjusted for varying the degree or extent of the reduction. The axes of rotation of the two members may be offset to provide additional G forces and a scrubbing action.

11 Claims, 2 Drawing Sheets

APPARATUS AND METHOD FOR REDUCING MATERIAL

BACKGROUND OF THE INVENTION

1. Field of the Invention

This invention relates to processing material similar to crushing or pulverizing, and, more particularly, to apparatus and a method for processing material utilizing centrifugal force.

2. Description of the Prior Art

U.S. Pat. No. 1,075,192 (Capen) discloses crusher apparatus or pulverizer apparatus utilizing a pair of disks. One disk is secured to and rotates with the main shaft, and the other disk has a sleeve extending downwardly therefrom and about the shaft of the other disk. The axes of the two elements, the shaft and the sleeve are inclined relative to each other.

U.S. Pat. No. 2,718,821 (Cumstin, Jr.) disclosed apparatus for refining pulp utilizing a pair of disks, one of which is rotatable, and the other of which is movable relative to the axes of rotation of the rotatable disk. That is, the axes of the non rotatable disk is movable relative to the axes of rotation of the rotating disk. Moreover, the nonrotatable disk is movable axially relative to the rotatable disk to vary spacing or distance between the two disk elements.

U.S. Pat. No. 3,926,381 (Musgrove & Connelly) discloses a milling device which utilizes a fixed upper stone and a rotatable lower stone. The lower, rotatable, stone includes a conical projection which extends upwardly through the upper stone and the conical projection is eccentrically oriented with respect to the axis of rotation of the lower stone. The upper stone includes a conical aperture into which the conical projection extends.

U.S. Pat. No. 4,257,564 (Pamplin) discloses crushing apparatus in which there is a bottom flat crushing surface and a upper conical surface disposed adjacent to the bottom plate. Both the upper element and lower element are rotatable. Material to be crushed moves outwardly and is crushed between the two elements as the conical surface approaches the bottom, flat, plate.

The axes of rotation of the two elements, the bottom or lower or flat plate, and the upper, conical, element are offset from each other.

All known prior art processes by grinding action. The apparatus of the present invention utilizes centrifugal force to accomplish the processing.

SUMMARY OF THE INVENTION

The invention described and claimed herein comprises method and apparatus for reducing material using centrifugal force as a primary element. The apparatus includes a flat bottom rotor plate and a generally conically tapered upper rotor cone disposed above the flat bottom rotor plate. The axis of rotation of the two elements may be offset, if desired.

Vertical spacing between the two elements is adjustable to provide different degrees of processing. The bottom, flat rotor plate is rotated at a very high speed, and the upper rotor cone is free-wheeling relative to the bottom rotor plate. The rotational velocity of the bottom plate provides relatively high G forces, and the reducing is accomplished by centrifugal force which causes the particle material to shatter or break apart into smaller and smaller pieces as the material moves outwardly between the rotors.

Offsetting the axes of rotation of the two elements increases the G forces or centrifugal forces involved and provides a scrubbing action.

Among the objects of the present invention are the following:

To provide new and useful reducing apparatus;

To provide new and useful apparatus for reducing virtually any type of material;

To provide new and useful reducing apparatus utilizing relatively high G forces;

To provide new and useful reducing apparatus utilizing a rotatable lower rotor plate and a free-wheeling generally conical upper rotor disposed above the lower flat rotor plate;

To provide new and useful processing apparatus in which a pair of rotatable members have offset and parallel axes of rotation;

To provide new and useful method of reducing material;

To provide a new and useful method of reducing material utilizing a pair of rotor elements;

To provide a new and useful method of reducing material utilizing a relatively high speed of rotation of a driven element to provide relatively high centrifugal and G forces; and To provide a new and useful method of reducing material in which a driven member has a relatively high rate of rotation and a driven member disposed above the driving member is free-wheeling relative to the driven member.

DESCRIPTION OF THE PREFERRED EMBODIMENT

Figure 1:
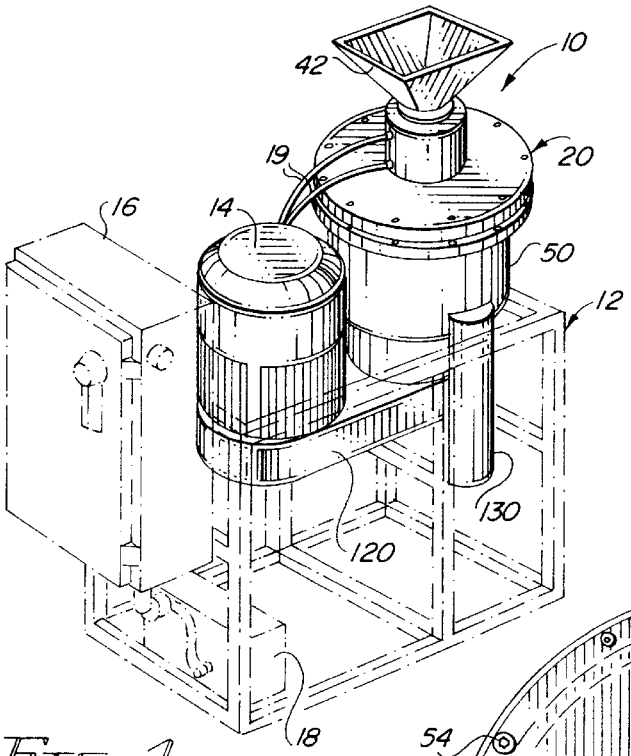
FIG. 1 is a perspective view of the apparatus of the present invention.
Figure 3:
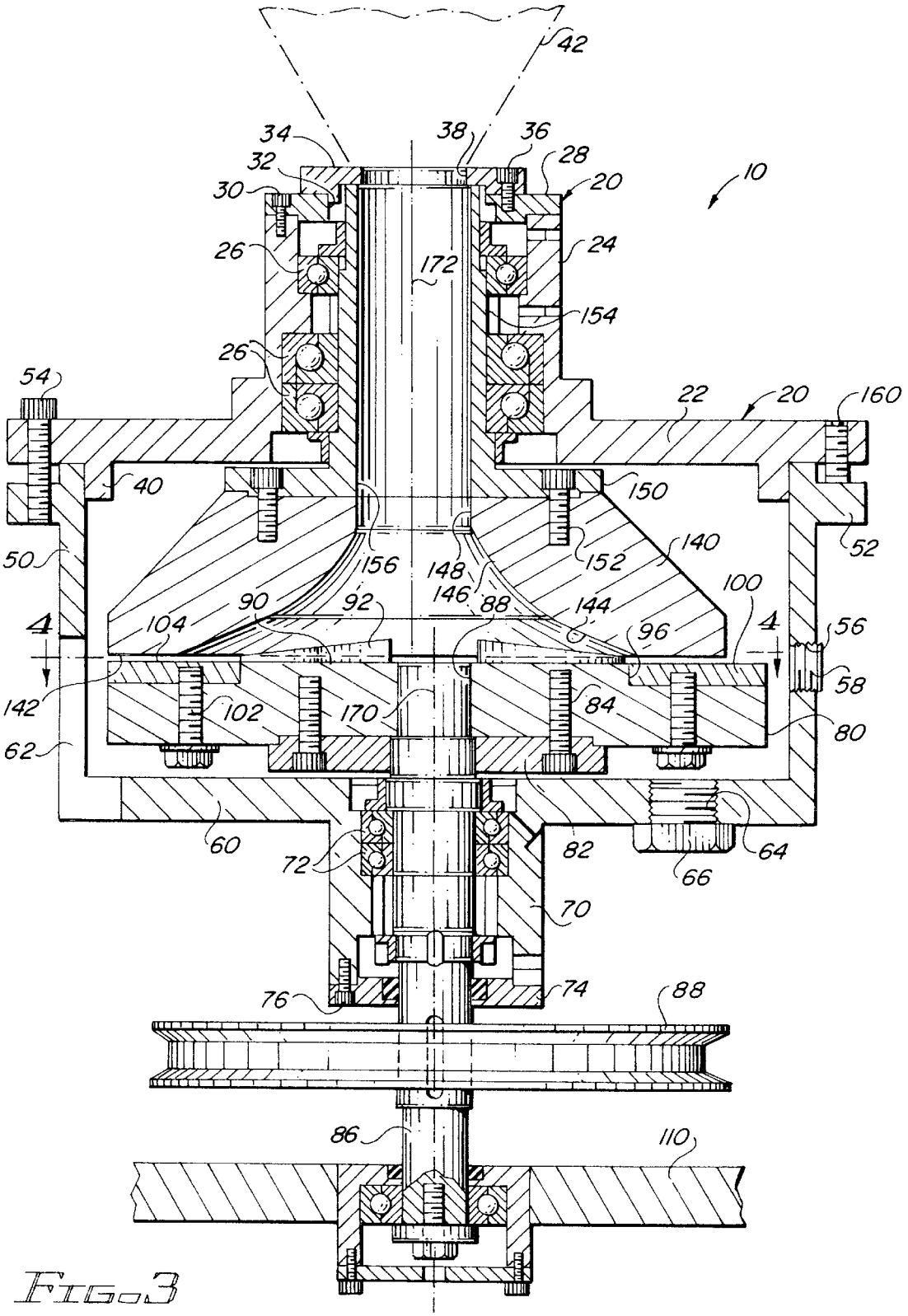
FIG. 3 is a view in partial section taken generally along line 3—3 of FIG. 2.

FIG. 1 is a perspective view of reducing apparatus 10 of the present invention. The reduction apparatus 10 includes a frame 12 to which is secured a motor 14, a control box 16, an oil reservoir 18, and reduction elements which are disposed within a reduction housing 20. Included within the control box 16 is an oil pump which pumps oil to bearings within the housing 20 for both a lower rotor and an upper rotor. The rotors are best shown in FIG. 3 and will be discussed in detail below. A pair of oil lines 19, which include a supply and return line for the upper rotor bearings, is shown in FIG. 1.

Figure 2:
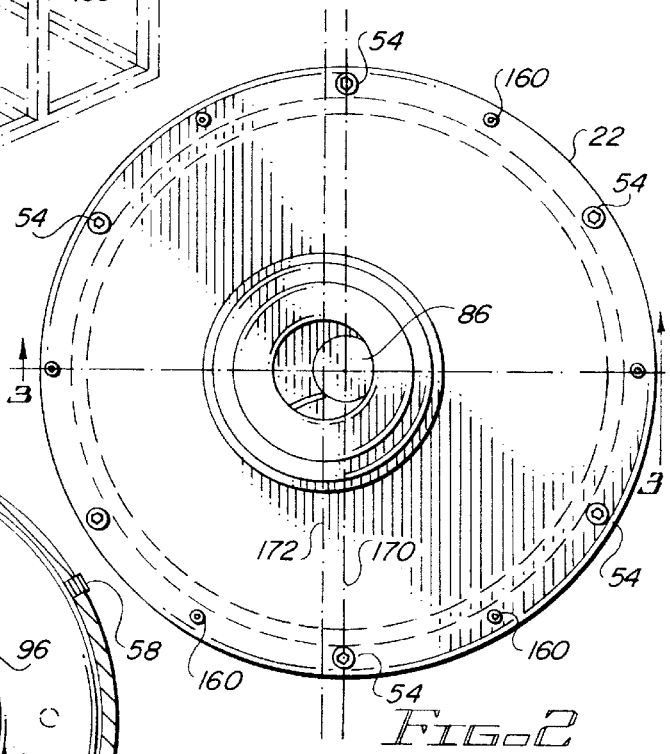
FIG. 2 is a top view of a portion of the apparatus of FIG. 1.
Figure 4:
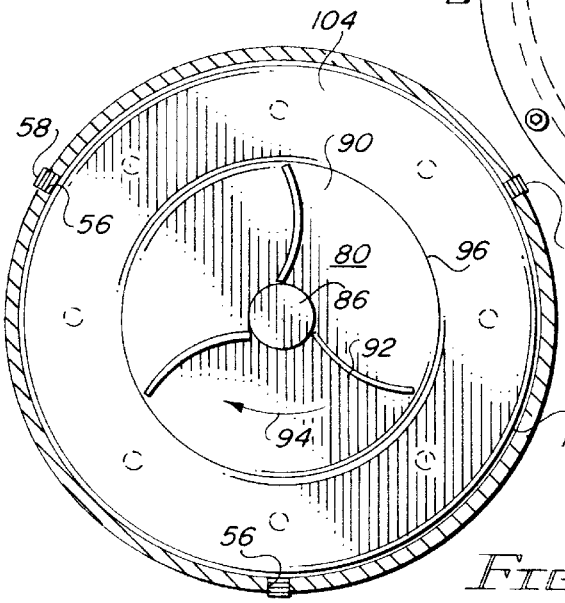
FIG. 4 is a view taken generally along line 4—4 of FIG. 3.

FIG. 2 is a top view of the reduction housing 20, and FIG. 3 is a view in partial section through the reduction housing 20 taken generally along line 3—3 of FIG. 2, disclosing the elements within the reduction housing 20 which accomplishes the reduction of whatever material is fed into the reduction housing 20. FIG. 4 is a view of a portion of the apparatus within the housing 20 taken generally along line 4—4 of FIG. 3. For the following discussion, reference will be made to all four of the drawing figures, with particular emphasis to FIG. 3.

The reduction housing 20 includes a top cover 22 which is generally of a circular configuration, as may best be understood from FIGS. 1 and 2. Extending upwardly from the cover 22 is a bearing boss 24. Within the bearing boss 24 are a plurality of bearing elements 26.

The bearing boss 24 is closed by a cap 28. The cap 28 is secured to the bearing boss 24 by a plurality of screw elements 30. Extending through the cap 28 is an aperture 32.

A top cap 34 is in turn secured to the cap 28 about the aperture 32. The top cap 34 is secured to the cap 28 by a plurality of fastener elements 36. An aperture 38 extends through the top cap 34. The aperture 38 is generally axially aligned with the aperture 32 in the cap 28.

The top cover 22 is appropriately secured to a generally cylindrical rotor housing 50. The cylindrical rotor housing 50 includes an outwardly extending flange 52, and the cover 22 is secured to the housing 50 by a plurality of fastener elements 54 extending into the flange 52. That is, the flange 52 includes a plurality of tapped apertures to receive the fastener elements 54, which are illustrated as cap screws.

Extending downwardly from the cover 22 is a circular downwardly extending rim 40, the outer diameter of which is substantially the same as the inner diameter of the rotor housing 50.

Extending through the housing 50 are viewing apertures 56. The viewing apertures 56 are closed by a plug 58.

The cylindrical rotor housing 50 is closed on its bottom by a bottom wall 60. Extending through a portion of the cylindrical housing 50 and the bottom 60 is a discharge opening 62. An aperture 64 extends through the bottom wall 60 and is closed by a plug 66. The purpose of the opening 64, and also the openings 56, will be discussed in detail below.

A bottom bearing boss 70 extends downwardly from the bottom wall 60. Within the boss 70 are appropriate bearing elements 72.

Disposed within the lower portion of the rotor housing 50 is a lower, primary or driven rotor 80. The rotor 80 is secured to a drive plate 82 by a plurality of appropriate fastener elements 84, such as cap screws. The drive plate 82 is in turn secured to a drive shaft 86. The drive shaft 86 extends upwardly into the rotor 80 through an aperture 88, and downwardly through the bearing elements 72 and the bearing boss 70 and outwardly from the bearing boss 70 through an aperture in a bottom cap 74. The bottom cap 74 is appropriately secured to the boss 70 by a plurality of fastener elements 76.

The bottom of the drive shaft is supported in appropriate bearings in a support plate 110. The plate 110 is secured to the frame 12. A pulley 88 is appropriately secured to the drive shaft 86. The pulley 88 is connected to the motor 14 by a belt (not shown) and rotation of the pulley 88 by the drive belt causes rotation of the shaft 86 and rotation of the rotor 80.

In FIG. 1, an enclosure 120 is shown extending between the bottom of the motor 14 and of the rotor housing 50. A discharge housing 130 is also shown in FIG. 1 extending downwardly from the rotor housing 50. The discharge housing 130 is appropriately secured about the discharge opening 62, shown in FIG. 3. The discharge housing comprises a chute through which reduced material exits from the reduction housing 20, and specifically from the rotor housing 50, and outwardly therefrom. If desired, the discharge housing or chute 130 may also extend horizontally. Moreover, there are preferably more than one discharge opening and chute on the lower housing 50. Two such openings and chutes, spaced apart one hundred eighty degrees, may provide satisfactory results.

Extending upwardly from the top surface of the rotor 80 are fins 92. The fins 92 are shown in FIG. 4 from the top. They curve away from the direction of rotation of the rotor 80. The direction of rotation of the rotor 80 is illustrated in FIG. 4 by the curved arrow 94.

A wear ring 100 is disposed on the top outer portion of the rotor 80. The rotor 80 includes a top surface 90, and the fins 92 extend upwardly from the top surface 90. Outwardly from the fins 92 is a shoulder 96. The wear ring 100 is disposed against the shoulder 96. The wear ring 100 is appropriately secured by a plurality of fasteners 102. The fasteners 102 are illustrated in FIG. 3 as being a plurality of bolts.

The wear ring 100 has a top surface 104 which is flush with the top surface 90 of the rotor 80.

It will be noted, as shown in FIG. 3, that the aperture 64 is located at a radius equal to the location of the fastener elements 102. Thus, when it is desired to change a wear ring 100, the fastener elements 102 may be removed through the aperture 64 after the plug 66 is removed, and may be reinserted into a new wear ring in generally the same fashion.

Spaced above the driven rotor 80 is a top rotor 140. The top rotor 140 includes a bottom surface 142 which is spaced apart from the top surface 104 of the wear ring 100 by a predetermined and adjustable distance. The distance between the bottom surface 142 or the upper, driven rotor 140, and the top surface 104 of the wear ring 100, which is flush or level with the top surface 90 of the rotor 80, determines the extent or degree of reduction of whatever material is fed into the apparatus 10.

The upper rotor 140 includes a "straight" conically configured surface 144 which extends upwardly and inwardly from the inner periphery of the surface 142. Above the "straight" conical central opening 146.

Material falls to the rotor 80 through the opening 148 and is slung outwardly to the surface 144. The top rotor 140 is secured to a support plate 150 by a plurality of appropriate fastening elements 152. The fastening elements 152 may be cap screws, if desired.

Extending upwardly from the support plate 150 is a hollow shaft 154. The shaft 154 is journaled for rotation in the bearing elements 26. The shaft 154 extends upwardly and terminates beneath the top cap 34. The shaft 154 includes a bore 156. The aperture 38 in the top cap 34 has a diameter slightly less than that of the bore 156 of the shaft 154. The diameter of the aperture 38 is slightly less than that of the bore 156.

The opening 148 in the rotor 140 is essentially a continuation of the bore 156. The two elements, the opening 148 and the bore 156 have the same diameter.

The rotor 80 is appropriately journaled for rotation within the housing 50, and the upper or top rotor 140 is appropriately journaled for rotation in the housing at the top cover 22 and its boss 24. Rotation of the top rotor 140 is in response to the rotation of the main or driven rotor 80, since the top rotor 140 does not include a separate drive system from that of the main rotor 80.

Spacing between the top surfaces 90 and 104 of the rotor 80 and the wear ring 100 and the bottom surface 142 of the top rotor 140 is adjusted by means of adjusting screws 160. In FIG. 2, the adjusting screws 160 are shown alternating with the fastener elements 54 about the periphery of the top cover 22.

The spacing between the bottom surface 142 of the top rotor 140 and the top surfaces 90 and 104 of the main rotor 80 and its wear ring 100 may be visualized through the apertures 56 when the plugs 58 are removed. In FIG. 4, three apertures 56 and their plugs 58 are shown. The apertures 56 are spaced apart 120 degrees so as to allow appropriated visualization and measuring to be made of the spacing as the adjusting screws 160 are rotated. Obviously, the fastener screws are loosened to accommodate the changing of the spacing, as desired.

In FIGS. 2 and 3, the axes of rotation of the main rotor 80 and the top rotor 140 are illustrated. The axis of rotation of the main rotor 80 is illustrated by a dash dot line 170, and the axis of rotation of the top rotor 140 is illustrated by dash dot line 172. The axes of rotation 170 and 172 are also shown in FIG. 2.

A hopper 42 is shown in FIG. 2, and is shown in phantom in FIG. 3, extending to the bore 156 of the shaft 154 of the upper rotor 140. Material to be reduced is fed into the apparatus 10 through the hopper 42.

With the main rotor 80 rotating at a relatively high speed, material falling through the bore 156 and onto the top surface 90 of the rotor 80 is moved or slung outwardly by centrifugal force. The outward movement of the material causes the material to pulverize or shatter as the material contacts or impinges upon the surface 144 and is forced through the space between the bottom surface 142 of the rotor 140 and the surface 104 of the wear ring 100. The distance between the surfaces 104 and 142 determines the extent to which the material is reduced.

The reduction of the material is accomplished by centrifugal force. The speed of rotation of the main or bottom rotor 80 causes the material falling downwardly through the bore 156 to be slung outwardly at a relatively high speed. The material impinges upon the conical surface 144 of the upper rotor 140 and breaks apart. The breaking apart, or reduction, or pulverization, of the material continues until the material is reduced to a size or dimension that will allow the reduced particulate material to pass between the top surface 104 of the wear ring 100 and the bottom surface 142 of the upper rotor 140.

The spacing, as discussed above, may be varied to provide the desired degree of reduction or particle size.

The bottom rotor 80 comprises an impeller which slings the material outwardly. The centrifugal and G forces involved are, of course, related to the rotational speed of the rotor or impeller 80 and the diameter of the rotor 80.

The offset axes of rotation of the two rotors increases the G forces and provides a scrubbing action for the material. Due to the offset, the material moves outwardly and the back inwardly. As the material moves back inwardly the G forces increase to move the material outwardly again.

Typically, the G forces resulting from the centrifugal forces involved may be in excess of one thousand, and may be in the order of fifteen or sixteen hundred or more. It is the rim speed of the bottom or driven rotor 80 which determines the centrifugal force.

It will be understood that virtually any type of material, mineral, vegetable, or metallic substances, may be reduced. Some metallic material may not be pulverized, but may be reduced to a relatively thin, shim stock-like configuration. Again, the thickness of the resulting material is substantially the vertical distance between the two rotor elements at their outer peripheries.

Rubber, glass and many other materials may also be reduced by the apparatus 10.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Apparatus for reducing material comprising in combination:

first rotor means for receiving material to be reduced, including a top surface and a generally horizontally disposed wear ring flush with the top surface;

means for rotating the first rotor at a relatively high speed to produce relatively high centrifugal force to sling outwardly the material disposed on the first rotor; and second rotor means disposed above the first rotor means for rotating in response to the rotation of the first rotor means, and including a conical surface against which the material impinges and is reduced and a bottom surface parallel and adjacent to the wear ring.

2. The apparatus of claim 1 in which the second rotor means further includes a bore through which material to be reduced falls onto the first rotor means.

3. The apparatus of claim 2 in which the first and second rotor means are movable vertically relative to each other to vary the distance between the top and bottom surfaces.

4. The apparatus of claim 2 in which the first rotor means further includes fins on the top surface to help sling the material outwardly.

5. The apparatus of claim 2 which further includes housing means for enclosing the first and second rotors.

6. The apparatus of claim 5 in which the housing means includes a discharge chute through which the reduced material moves.

7. The apparatus of claim 1 in which the first rotor means has a first axis of rotation and the second rotor means has a second axis of rotation, and the second axis of rotation is offset from the first axis of rotation.

8. A method of reducing material comprising the steps of providing a first rotor;

rotating the first rotor to provide relatively high centrifugal force to sling material outwardly;

providing a conical surface against which the slung material impinges to reduce the material;

providing a bottom surface adjacent to the conical surface; and providing a wear ring on the first rotor beneath the bottom surface and parallel thereto.

9. The method of claim 8 which further includes the step of providing a second rotor rotating in response to rotation of the first rotor, and the conical surface against which the material impinges and the bottom surface are on the second rotor.

10. The method of claim 9 which further includes the step of providing a top surface on the first rotor and the distance between the top and bottom surfaces determines the extent of reduction of the material.

11. The method of claim 10 which includes the further step of varying the distance between the top and bottom surfaces to vary the extent of reduction of the material.

* * * * *